United States Patent [19]

Lange et al.

[11] 4,456,294

[45] Jun. 26, 1984

[54] ADJUSTABLE GARDEN CHAIR

[76] Inventors: Jürgen Lange, In Der Stegmühle, Grafenau; Alexander Härty, Langer Weg 19, Untersiemau, both of Fed. Rep. of Germany

[21] Appl. No.: 304,604

[22] Filed: Sep. 22, 1981

[30] Foreign Application Priority Data

Sep. 26, 1980 [DE] Fed. Rep. of Germany ..... 8025831

[51] Int. Cl.[3] ..... A47C 3/20

[52] U.S. Cl. ..... 297/21; 297/377

[58] Field of Search ..... 297/21, 22, 377, 325, 297/328, 354

[56] References Cited

U.S. PATENT DOCUMENTS

| | | | |
|---|---|---|---|
| 538,708 | 5/1895 | Smith | 297/354 X |
| 1,366,274 | 1/1921 | Orth | 297/377 X |
| 4,125,286 | 11/1978 | Redel | 297/325 |

FOREIGN PATENT DOCUMENTS

| | | | |
|---|---|---|---|
| 91268 | 4/1897 | Fed. Rep. of Germany | 297/21 |
| 2334114 | 1/1975 | Fed. Rep. of Germany | 297/354 |
| 2735522 | 2/1979 | Fed. Rep. of Germany | 297/354 |
| 226036 | 12/1924 | United Kingdom | 297/21 |

*Primary Examiner*—William E. Lyddane
*Assistant Examiner*—Peter R. Brown
*Attorney, Agent, or Firm*—Bacon & Thomas

[57] ABSTRACT

A garden chair including a back rest, a seat, and a cross frame defined by first and second pairs of support braces rotatably connected together through a first axle. The first pair of support braces are also rotatably connected to the front of the seat through a second axle, and the rear of the seat is rotatably connected to the back rest through a third axle. An arm provided with a longitudinal slot connects the second pair of braces to the back rest, with the third axle passing through the longitudinal slot. A free end of the arm and the back rest are engageable in a plurality of positions to permit vertical adjustment of the seat.

10 Claims, 3 Drawing Figures

ADJUSTABLE GARDEN CHAIR

BACKGROUND OF THE INVENTION

1. Field of the Invention

The present invention generally relates to chair structures and, more particularly, involves an improved garden chair having a vertically adjustable seat.

2. Description of the Prior Art

Garden chairs having vertically adjustable seats are known in the art and generally comprise a seat mounted on a cross frame defined by two pairs of support braces which engage the seat at its front and rear edges, with the braces being rotatably connected to each other through a cental axle of rotation, the axis of which is substantially parallel to the front and rear edges of the seat.

The pair of support braces which connect to the rear edge of the seat also forms a portion of a back rest, with the latter being further defined by arcuate longitudinal braces which extend under the seat. The seat is rotatably connected at its rear edge with the back rest through an axle of rotation that is essentially parallel to the front and rear edges of the seat, and being provided with two locking slots extending in the longitudinal direction of the seat and facing each other.

A pair of aligned lateral locking pins are provided at the upper adjacent ends of the other support braces for engagement with the corresponding locking slots. The locking slots have a comb-like configuration and are defined by a plurality of lateral slots arranged at varying distances from the rear edge of the seat. The lateral slots are directed away from the central axle of rotation of the support braces and serve to receive the corresponding locking pins in the established vertical position of the seat. The back rest is provided with a certain degree of inclination since its longitudinal braces serve to form one pair of support braces under the seat, with the rearward inclination of the back rest increasing with the depth of seat adjustment.

SUMMARY OF THE INVENTION

It is an object of the present invention to provide an improved adjustable garden chair wherein the vertical adjustment of the seat can be accomplished in a simple and efficient manner.

It is another object of the invention to provide an improved garden chair that can be adjusted without need for the user to either apply excessive force or perform complicated adjustment procedures.

It is a further object of the invention to provide an improved adjustable garden chair wherein the locking of the chair in an established position of adjustment can be readily observed.

It is still another object of the invention to provide an improved garden chair having a spring supported configuration.

These and other objects are realized through the present invention by providing an improved chair which comprises a seat, a back rest, and a cross frame defined by first and second pairs of support braces which are rotatably connected to each other through a first axle of rotation. The first pair of support braces is also connected to the front edge of the seat through a second axle of rotation, and the rear edge of the seat is connected to the back rest through a third axle of rotation. An arm including a longitudinal slot, preferably defined by a pair of spaced spring metal sheets, connects the second pair of braces to the back rest, with the third axle of rotation passing through the longitudinal slot. Means are carried by both the arm and back rest for permitting vertical adjustment of the seat, with such means preferably including a pair of locking pins carried by a free end of the arm for engagement into corresponding slots provided in locking plates carried by the back rest.

Other objects, features and advantages of the present invention shall be apparent from the following description of specific embodiments thereof, with reference to the accompanying drawings, which form a part of the specification, wherein like reference characters designate corresponding parts of the several views.

DETAILED DESCRIPTION OF THE PREFERRED EMBODIMENTS

Figure 1:
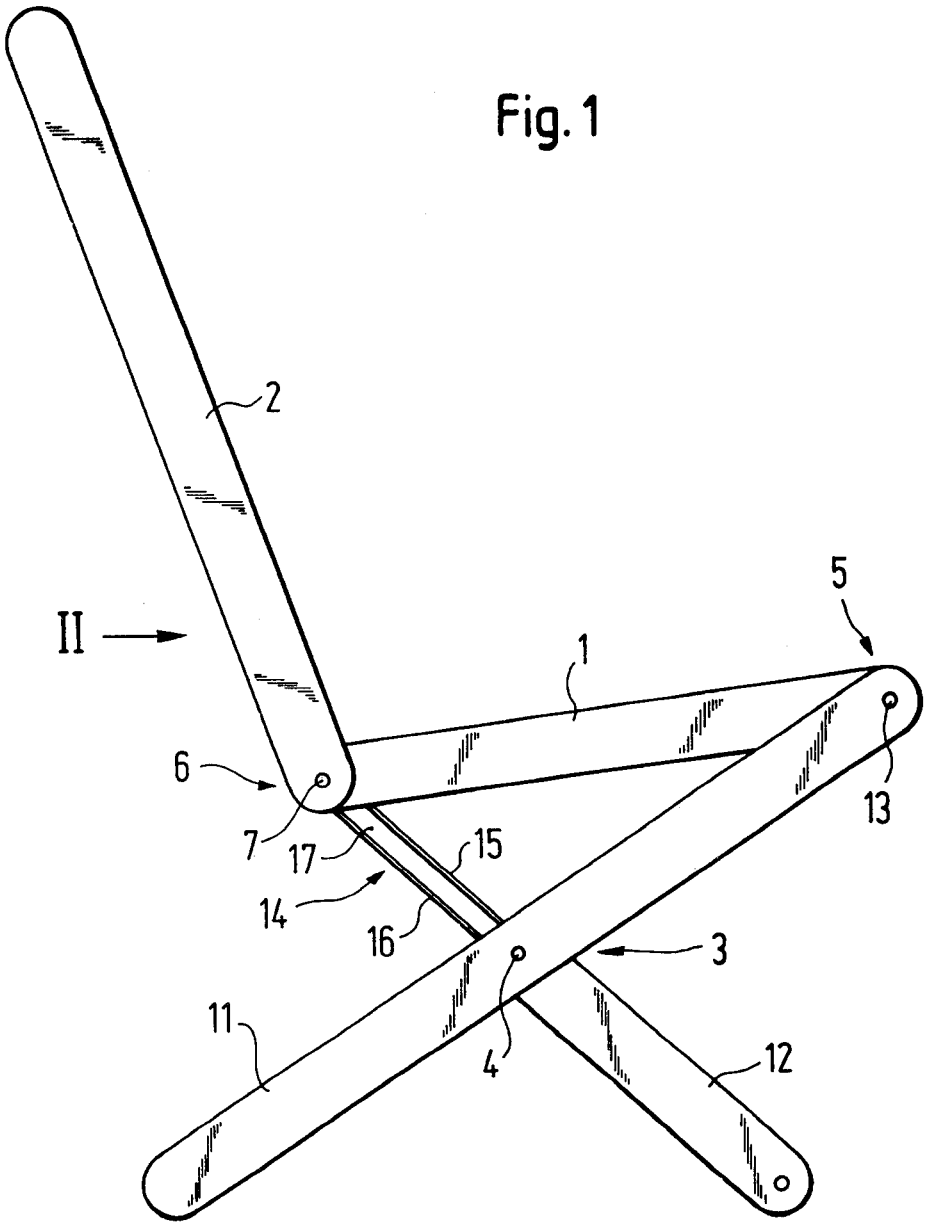
FIG. 1 is a side elevational view, in schematic, of a garden chair according to the invention.

A garden chair according to the invention is shown in FIG. 1 and comprises a seat 1, a back rest 2 and a cross frame 3, with the latter permitting adjustment of the vertical position of seat 1 with respect to the surface on which the chair is supported. Cross frame 3 is provided with a first axle of rotation 4 having a longitudinal axis that extends substantially parallel to the front edge and rear edge, designated generally at 5 and 6 respectively, of seat 1. Cross frame 3 includes a first pair of support braces 11 and a second pair of support braces 12, which support braces 11 and 12 are rotatably connected to each other through first axle of rotation 4. Support braces 11 are rotatably connected to front edge 5 of seat 1 through a second axle of rotation 13 having a longitudinal axis disposed substantially parallel to first axle of rotation 4. Seat 1 and back rest 2 are rotatably connected to each other through a third axle of rotation 7 having a longitudinal axis disposed substantially parallel to first axle of rotation 4 and second axle of rotation 13.

First and second pairs of support braces 11 and 12 are preferably in the form of elongate members, wherein support braces 11 are connected at one pair of corresponding ends to second axle of rotation 13, with the remaining pair of corresponding ends extending in a rearward direction. Support braces 12 have one pair of corresponding ends connected at first axle of rotation 4, with the remaining pair of corresponding ends extending in a forward direction.

Figure 2:
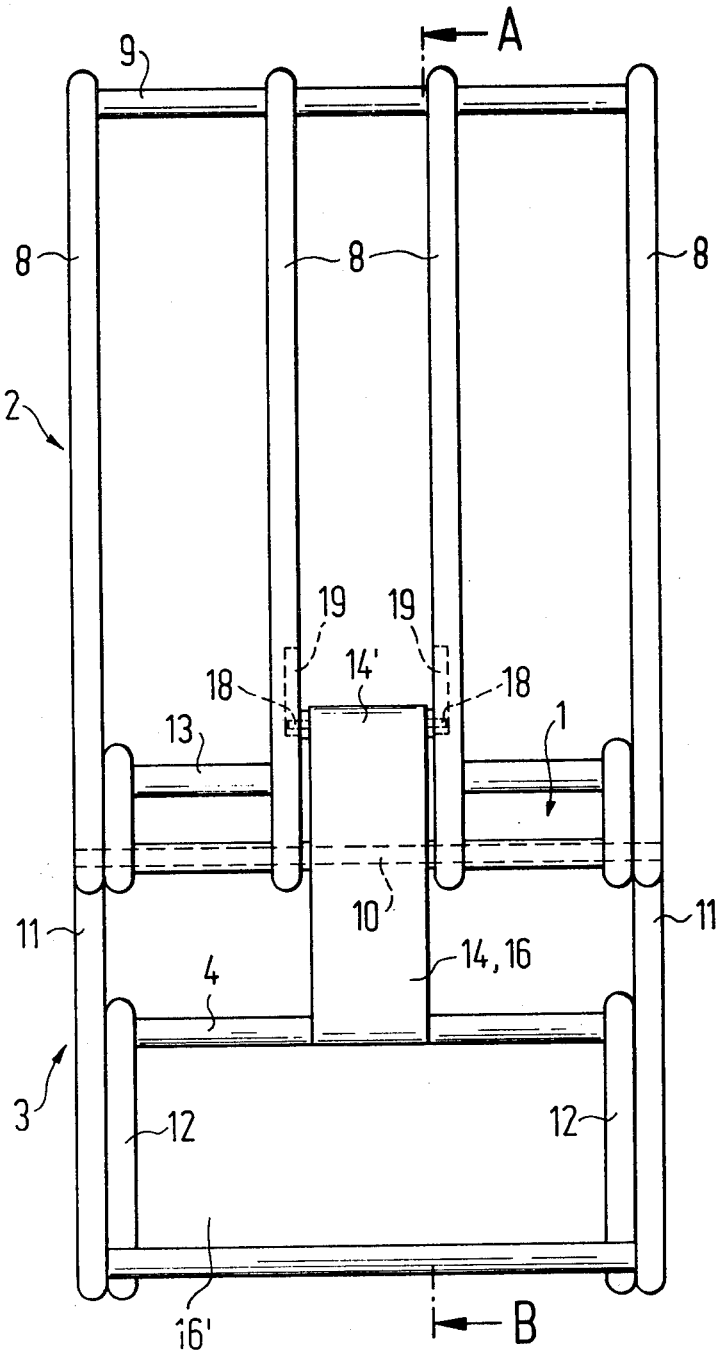
FIG. 2 is a rear view of the garden chair of FIG. 1 viewed in the direction of arrow II in FIG. 1.

As shown in FIG. 2, back rest 2 may be provided with four longitudinal braces 8 which are disposed parallel to and spaced from each other. Braces 8 are interconnected at their upper ends by a transverse brace 9 and at their lower ends by third axle of rotation 7. Seat 1 is also rotatably supported on third axle of rotation 7.

An arm 14 is provided for connecting support braces 12 to back rest 2. Arm 14 may be in the form of a metal fitting including two spaced plates 15 and 16, preferably of sheet spring steel. Plates 15 and 16 are disposed substantially parallel to each other and extend downwardly past first axle of rotation 4 between second support braces 12 whereby arm 14 includes a wider section designated 15' and 16', with the latter being secured to second support braces 12. The narrower section of arm 14 extends upwardly from first axle of rotation 4 towards seat 1 and back rest 2, with this section of arm 14 defining a longitudinal slot 17 through which third axle of rotation 7 is passed.

Arm 14 serves to secure second support braces 12 to back rest 2 through a free end 14', the latter including a pair of lateral locking pins 18 which are axially aligned with each other for engagement with a plurality of slots provided in opposed corresponding locking plates 19 carried by longitudinal braces 8 of back rest 2. As more particularly seen in FIG. 3, locking plates 19 extend in the longitudinal direction of back rest 2, with slots 20 defining a substantially comb-like configuration for each plate 19. Slots 20 are spaced from each other and therefore define varying distances from third axle of rotation 7, with each tooth of the comb-like configuration of plate 19 being disposed at an acute angle $\alpha$ with respect to the longitudinal axis 21 of each longitudinal brace 8.

In the locking state, locking pins 18 are engaged in corresponding aligned slots 20 of locking plates 19 in order to support back rest 2 in a desired position of adjustment. During the engagement of locking pins 8 into their corresponding slots 20, third axle of rotation 7 is guided within longitudinal slot 17 of arm 14. While the shape of arm 14 is depicted in FIG. 3 as having a downwardly bent configuration, it is understood that this configuration may be modified, thereby providing a corresponding modification of longitudinal slot 17, to provide various inclinations of back rest 2 in coordination with various vertical adjustments of seat 1.

In the embodiment depicted by the drawings, seat 1 is shown at its highest position since locking pins 18 of arm 14 are engaged within the lowermost slots 20 of locking plate 19. In order to lower seat 1 and thereby reduce its distance from the base surface on which the chair is supported, it is only necessary to slightly raise back rest 2 so that locking pins 18 of arm 14 are lifted out of their respective slots 20. Thereafter, back rest 2 may then be lowered until the desired vertical height of seat 1 is achieved and locking pins 18 of arm 14 are then secured within the corresponding slots 20 at this desired position of adjustment.

As is apparent, the garden chair of this invention is extremely easy to manipulate and permits a simple means for adjusting the vertical position of seat 1. The position of adjustment and engagement of arm 14 to back rest 2 is readily ascertainable by visual inspection and the overall structure and mechanism of this chair provides both stable and safe support during use.

Figure 3:
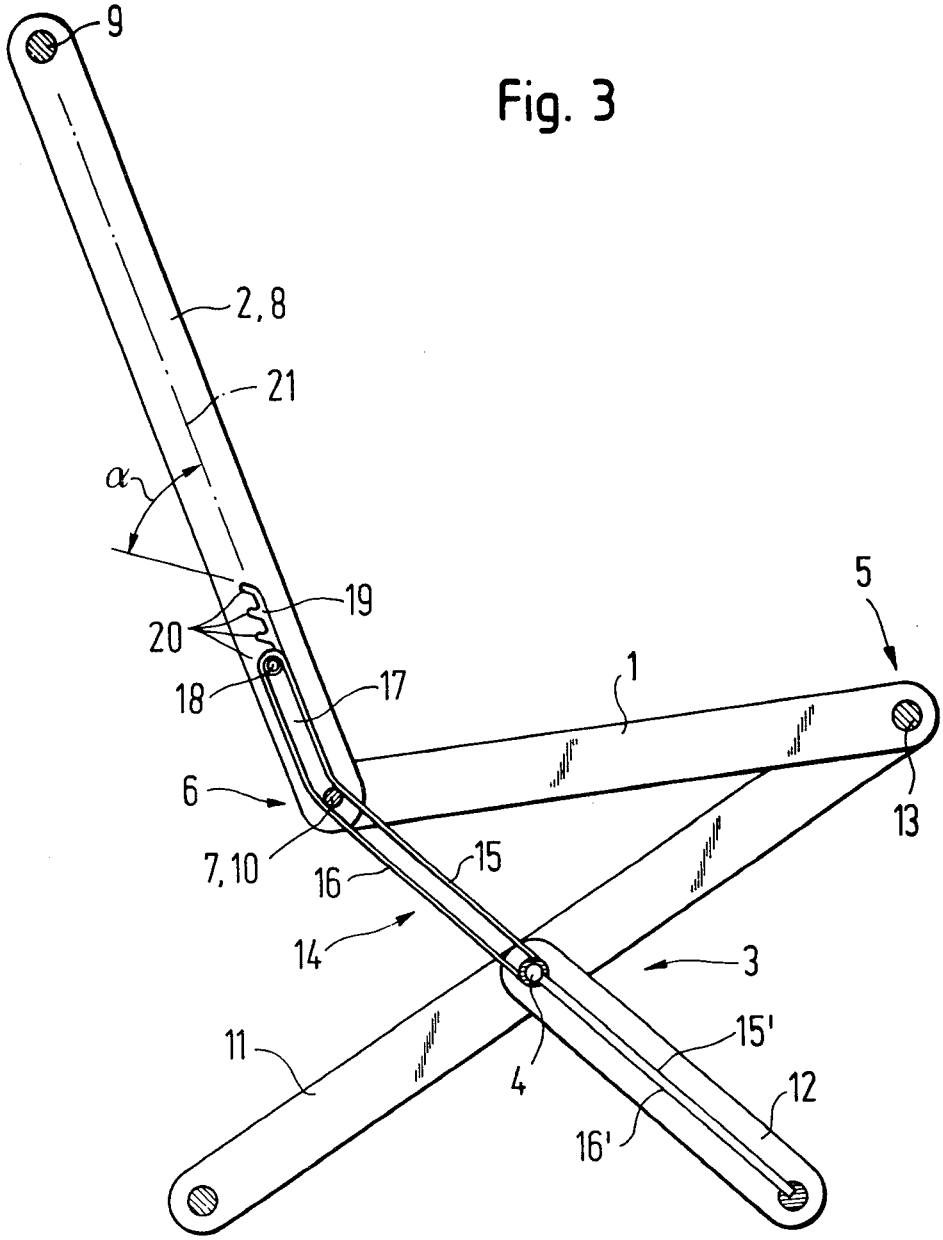
FIG. 3 is a sectional view taken along the line A-B in FIG. 2.

While arm 14 may be made of any suitable material, the use of spring steel sheets for this purpose imparts an excellent spring action which is enhanced through the bent configuration of arm 14 as shown in FIG. 3. This serves to provide spring support for seat 1 and back rest 2 against cross frame 3. This also provides an economical approach for significantly enhancing the seating comfort of the chair.

It is to be understood that embodiments of the invention herein shown and described are to be taken as preferred examples of the same, and that various changes in the shape, size, arrangement of parts and applications may be resorted to, without departing from the spirit of the invention or scope of the subjoined claims.

We claim:

1. An adjustable garden chair including a seat, back rest, and a cross frame defined by first and second pairs of support braces, which chair comprises:
   (a) a first axle for rotatably connecting the first and second pairs of support braces;
   (b) a second axle for rotatably connecting the first pair of support braces to the front of the seat;
   (c) a third axle for rotatably connecting the rear of the seat to the back rest;
   (d) an arm provided with a longitudinal slot therethrough for connecting the second pair of support braces to the back rest, wherein the arm is secured to the second pair of support braces and extends upwardly from the first axle of rotation towards the seat and the back rest and wherein the third axle of rotation passes through the longitudinal slot; and
   (e) means carried by the arm and back rest for permitting vertical adjustment of the seat.

2. An adjustable garden chair including a seat, back rest, and a cross frame defined by first and second pairs of support braces, which chair comprises:
   (a) a first axle for rotatably connecting first and second pairs of support braces;
   (b) a second axle for rotatably connecting the first pair of support braces to the front of the seat;
   (c) a third axle for rotatably connecting the rear of the seat to the back rest;
   (d) an arm including a pair of spaced plates defining a longitudinal slot therebetween for connecting the second pair of support braces to the back rest, wherein the third axle of rotation passes through the longitudinal slot; and
   (e) means carried by the arm and back rest for permitting vertical adjustment of the seat.

3. The chair of claim 2 wherein the plates include a narrow portion and a wide portion, with the wide portion being disposed between the second pair of braces.

4. The chair of claim 2 wherein the plates are of metal.

5. The chair of claim 4 wherein each plate is of spring steel.

6. The chair of claim 5 wherein each spring steel plate is of a sheet configuration.

7. An adjustable garden chair including a seat, back rest, and a cross frame defined by first and second pairs of support braces, which chair comprises:
   (a) a first axle for rotatably connecting the first and second pairs of support braces;
   (b) a second axle for rotatably connecting the first pair of support braces to the front of the seat;
   (c) a third axle for rotatably connecting the rear of the seat to the back rest;
   (d) an arm provided with a longitudinal slot therethrough for connecting the second pair of support braces to the back rest, wherein the third axle of rotation passes through the longitudinal slot; and
   (e) means carried by the arm and back rest for permitting vertical adjustment of the seat, which means includes a pair of opposed locking pins carried by a free end of the arm and a pair of opposed locking plates carried by the back rest, with each locking plate including a plurality of spaced slots for selective engagement by a corresponding locking pin.

8. The chair of claim 7 wherein the back rest includes a pair of spaced and substantially parallel longitudinal braces, with each longitudinal brace carrying a locking plate.

9. An adjustable garden chair including a seat, back rest, and a cross frame defined by first and second pairs of support braces, which chair comprises:

(a) a first axle for rotatably connecting the first and second pairs of support braces;

(b) a second axle for rotatably connecting the first pair of support braces to the front of the seat;

(c) the first pair of support braces are each of an elongate configuration and extend rearwardly from their connection at the second axle;

(d) the second pair of support braces are each of an elongate configuration and extend forwardly from their connection at the first axle;

(e) a third axle for rotatably connecting the rear of the seat to the back rest;

(f) an arm provided with a longitudinal slot therethrough for connecting the second pair of support braces to the back rest, wherein the third axle of rotation passes through the longitudinal slot; and (g) means carried by the arm and back rest for permitting vertical adjustment of the seat.

10. The chair of claim 9 wherein the second pair of support braces have one pair of corresponding ends connected to the first pair of support braces at the first axle.

* * * * *